US007185679B2

(12) United States Patent
Schwemmlein et al.

(10) Patent No.: US 7,185,679 B2
(45) Date of Patent: Mar. 6, 2007

(54) HEDDLE, ESPECIALLY LIFTING HEDDLE

(75) Inventors: Christoph Schwemmlein, Borken-Weseke (DE); Kurt Hockemeyer, Borken-Weseke (DE)

(73) Assignee: Gebuder Klöcker GmbH, Borken Weseke (DE)

( * ) Notice: Subject to any disclaimer, the term of this patent is extended or adjusted under 35 U.S.C. 154(b) by 0 days.

(21) Appl. No.: 11/153,807

(22) Filed: Jun. 15, 2005

(65) Prior Publication Data

US 2005/0284532 A1 Dec. 29, 2005

(30) Foreign Application Priority Data

Jun. 25, 2004 (DE) ..... 10 2004 030 913

(51) Int. Cl.
*D03C 9/00* (2006.01)

(52) U.S. Cl. ..... 139/93; 139/54

(58) Field of Classification Search ..... 139/90–96, 139/50, 54, 195
See application file for complete search history.

(56) References Cited

U.S. PATENT DOCUMENTS 1,893,288 A * 1/1933 Kaufmann ..... 139/96
2,623,547 A * 12/1952 Abbott ..... 139/92
4,790,357 A * 12/1988 Kramer ..... 139/91
5,871,035 A * 2/1999 Kramer et al. ..... 139/92
6,955,191 B2 * 10/2005 Hockemeyer et al. ..... 139/52

FOREIGN PATENT DOCUMENTS

| | | |
|---|---|---|
| DE | 39 12 733 | 7/1990 |
| EP | 0 344 428 | 4/1992 |

* cited by examiner

*Primary Examiner*—Gary L. Welch
*Assistant Examiner*—Andrew W. Sutton
(74) *Attorney, Agent, or Firm*—Thomas R. Vigil; Pyle & Piontek

(57) ABSTRACT

The subject matter of the invention is a heddle (1), more specifically a lifting heddle as part of a leno selvedge device, the heddle comprising a head portion and a base portion with a closed or an open eyelet for mounting to a heddle frame or to a heddle ridge bar (13), the head portion and/or base portion (2, 3) being adapted to be secured stationarily to the heddle frame or the heddle ridge bar (13), with the head portion (2) and/or the base portion (3) being adapted to be interlockingly and non-slidably fixed to the heddle frame or to the heddle ridge bar (13) by means of a detent system (11, 12, 13*a*).

7 Claims, 1 Drawing Sheet

HEDDLE, ESPECIALLY LIFTING HEDDLE

CROSS-REFERENCE TO RELATED APPLICATIONS

This application claims Priority from German Application No. DE 10 2004 030 913.2-26 filed on 25. Jun. 2004

BACKGROUND OF THE INVENTION

1. Field of the Invention

The present invention relates to a heddle, especially to a lifting heddle as a part of a leno selvedge device, said heddle comprising a head portion and a base portion with a closed or an open eyelet for mounting to a heddle frame or to a heddle ridge bar, said head portion and/or base portion being adapted to be secured stationarily to the heddle frame or the heddle ridge bar. As used herein, the term "open eyelet" is to be construed as a slot for example.

2. Description of the Prior Art

Various heddles are known in the weaving trade. Lifting heddles are more specifically known to be part of a leno selvedge device, in which one half heddle is alternately carried along by the lifting heddles to form the leno selvedge. In the region of its upper crosspiece, the half heddle comprises an eyelet for receiving the stationary thread, a leno thread being guided between half heddle and lifting heddle, said leno thread passing at each change of shed from one side of the half heddle to the other side of said half heddle for forming the leno weave (DE 39 12 733 C1).

To facilitate mounting of the lifting heddles to the heddle frames or to the heddle ridge bars receiving the lifting heddles, it is already known to provide the head portion of such a lifting heddle with a pivotal bracket (EP 0 344 428 A1). At the opposite end of the lifting heddle, that is, on the base portion, there is provided an opening for receiving the other heddle frame or the other opposite heddle ridge bar. By attaching the lifting heddles in this manner to the heddle ridge bars or to the heddle frames, the heddles are not prevented from moving laterally on the heddle ridge bars or the heddle frames.

What are termed mini leno selvedge apparatus are moreover known, which can also be utilized in particular in the center of the fabric, e.g., when the fabric is divided in its center, or in the dent bar when multiple webs are being woven. Such type mini leno selvedge apparatus possess heddle ridge bars in the form of a finger-shaped extension, the length of said finger-shaped extension corresponding at the most to the width of the head portion or of the base portion of the heddle so that the outer edge of the head portion or of the base portion is flush with the front-side end of the heddle ridge bar. This is necessary because the warp yarn glides along the heddle. If the end of the heddle ridge bar projects beyond the width of the heddle, this would impair the travel of the warp yarn along the heddle.

To fix the heddle on the heddle ridge bar, it is now known to screw the heddle to the lifting heddle in the region of its head portion or of its base portion. This means that the head portion for example comprises a through hole that is oriented axially parallel with a corresponding hole in the heddle ridge bar so that the heddle is fixable to the heddle ridge bar by means of an M2 screw. Screws larger than M2 cannot be utilized since the size of the head portion or the base of the heddle forbids the use of larger screws. Manipulation of an M2 screw is very complicated as such a screw gets easily lost and is also very difficult to manipulate by hands.

BRIEF SUMMARY OF THE INVENTION

It is the object of the invention to form a heddle of the type mentioned herein above in such a manner that it can be readily secured to the heddle frame or a heddle ridge bar by means of captive parts and by toolless mounting.

In accordance with the invention, this object is solved by having the head portion and/or the base portion adapted to be interlockingly, more specifically non-slidably, fixed to the heddle frame or to the heddle ridge bar by means of a detent system. Accordingly, the heddle, more specifically the lifting heddle, is snap-fitted onto the heddle ridge bar. Mounting is much easier this way than if small screws are to be cumbersomely inserted and screwed into small openings whereby it is further possible that access be restricted during mounting.

Advantageous features of the invention are described in the subordinate claims.

There is more specifically provided that the eyelet of the head portion and/or of the base portion of the heddle corresponds approximately to the cross section of the heddle frame or of the heddle ridge bar, with the detent system including a detent lug or knob that is directed toward the heddle frame or of the heddle ridge bar and is adapted for insertion into a mating detent opening of the heddle frame or of the heddle ridge bar. Heddles, and more specifically lifting heddles, are substantially made from a plastic material. Such plastic materials have a certain inherent elasticity so that the detent lug is pressed into the mating opening in the heddle frame or in the heddle ridge bar in the region of its head portion or of its base portion by the very inherent elasticity of the plastic material. In order to prevent the detent lug from inadvertently slipping out of the detent opening as a result of the vibrations occurring during operation of the weaving machine, there is provided, according to another feature, that a resilient tongue be disposed in the wall of the eyelet facing the detent lug, said tongue pushing the detent lug into, or pulling it out of, the detent opening, that is to say that the tongue projects into the eyelet when not mounted to the heddle ridge bar.

According to another feature, the head portion and/or the base portion comprises a magnet located behind the knob or the detent lug. Accordingly, the magnet is in the immediate neighborhood of the heddle ridge bar or of the heddle frame. The heddle ridge bar in particular is made from metal so that, thanks to the magnetic force it exerts onto the heddle ridge bar, the magnet prevents the knob or the detent lug from slipping out of the detent opening. This means that the detent lug is pulled into the detent opening by the magnetic force.

In accordance with another feature, the resilient tongue itself additionally comprises another knob so that the ridge bar is taken hold of from two sides in a tongs-like fashion with the knobs or the detent lugs engaging the detent openings from two sides.

The invention will be understood better upon reading the exemplary description accompanying the drawing.

DETAILED DESCRIPTION OF THE INVENTION

Figure 1:
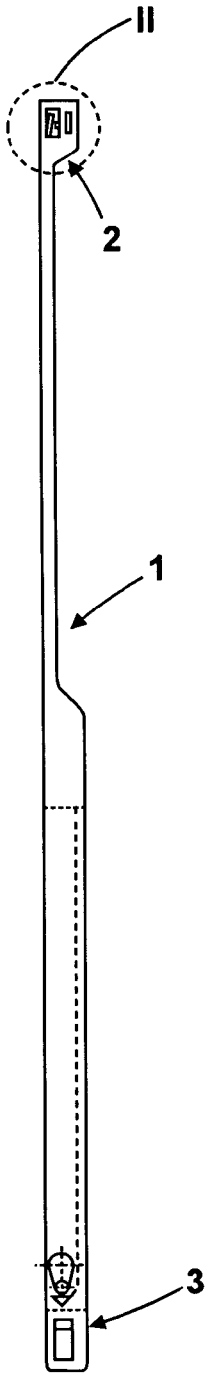
FIG. 1 is a side view of a lifting heddle.
Figure 2:
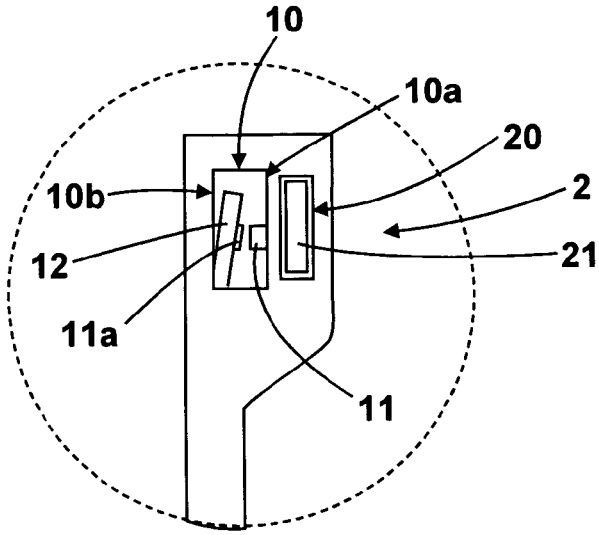
FIG. 2 illustrates to an enlarged scale detail II of FIG. 1.
Figure 3:
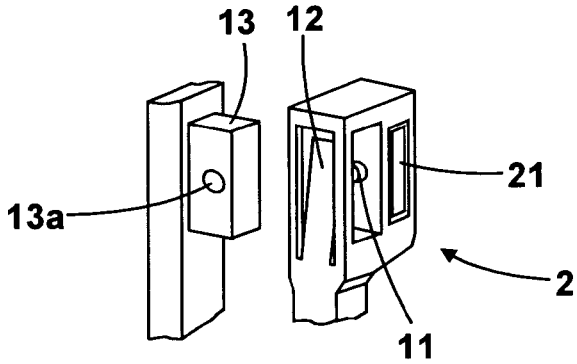
FIG. 3 is a perspective view of a portion of the leno selvedge apparatus with a heddle ridge bar in the form of a finger-shaped extension.

The heddle, which is indicated generally at 1, comprises a head portion 2 and a base portion 3. The base portion 2 possesses an eyelet labeled at 10 in the form of a slot or an opening. The latter needs not be closed at the top, as one would expect an "eyelet" to be. Inasmuch, it may be an open eyelet. In the mounted state of the lifting heddle, the eyelet 10 has two vertical walls 10*a* and 10*b*, a knob 11 being provided on, and associated with, the wall 10*a* of the eyelet 10. In the region of the wall 10*b* of the eyelet 10 there is the resilient tongue 12. The resilient tongue 12 causes the detent lug or the knob 11 to be pushed or pulled into the detent opening 13*a* of the heddle ridge bar 13 (FIG. 3). The resilient tongue 12 itself advantageously also comprises a detent lug or knob 11*a*, with the heddle ridge bar being taken hold of in a tongs-like fashion. If the detent opening 13*a* in the heddle ridge bar 13 is a through hole, the two detent lugs 11, 11*a* engage this detent opening from opposite sides.

Parallel to the eyelet 10, an opening 20 into which a magnet is inserted may be provided in the head portion of the lifting heddle, said opening serving to accommodate a magnet 21 that additionally ensures that the detent opening 13*a* of the heddle ridge bar is pressed against the knob 11.

We claim:

1. A heddle comprising a head portion and a base portion with a closed or an open eyelet for mounting to a heddle frame or to a heddle ridge bar (13), said head portion and/or base portion (2, 3) being adapted to be secured stationarily to the heddle frame of the heddle ridge bar (13), characterized in that the head portion (2) and/or the base portion (3) is interlockingly and non-slidably fixed to the heddle frame or the heddle ridge bar (13) by means of a detent system (11, 12, 13*a*).

2. The heddle as set forth in claim 1, characterized in that the head portion (2) and/or the base portion (3) of the heddle (1) comprises an eyelet (10) that corresponds approximately to the cross section of the heddle frame or the heddle ridge bar (13) by means of a detent system (11, 12, 13*a*) including a detent lug (11) that is directed toward the heddle frame or the heddle ridge bar (13) and is adapted for insertion into a mating detent opening (13*a*) of the heddle frame or of the heddle ridge bar (13).

3. The heddle as set forth in claim 2, characterized in that the detent lug (11) is disposed in the vertically oriented wall (10*a*) of the eyelet (10) when the heddle (1) is mounted.

4. The heddle as set forth in claim 2, characterized in that a resilient tongue (12) is disposed in the wall (10*b*) of the eyelet (10) facing the detent lug (11), said detent lug (11) being pressed into the detent opening (13*a*) by said tongue (12).

5. The heddle as set forth in claim 1, characterized in that the head portion (2) and/or the base portion (3) comprises a magnet (21) behind the detent lug (11).

6. The heddle as set forth in claim 4, characterized in that the tongue (12) comprises a detent lug (11*a*).

7. The heddle of claim 1 being a lifting heddle (1) forming a part of a leno selvedge device.

* * * * *